US007798779B2

(12) United States Patent
Nogami et al.

(10) Patent No.: US 7,798,779 B2
(45) Date of Patent: Sep. 21, 2010

(54) STEAM TURBINE BLADE, AND STEAM TURBINE AND STEAM TURBINE POWER PLANT USING THE BLADE

(75) Inventors: Shuuhei Nogami, Sendai (JP); Nobuhiro Isobe, Hitachi (JP); Hajime Toriya, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 910 days.

(21) Appl. No.: 11/657,613

(22) Filed: Jan. 25, 2007

(65) Prior Publication Data

US 2007/0207034 A1 Sep. 6, 2007

(30) Foreign Application Priority Data

Mar. 2, 2006 (JP) ..... 2006-056069

(51) Int. Cl.
*F01D 5/34* (2006.01)

(52) U.S. Cl. ..... 416/220 R; 416/248

(58) Field of Classification Search ..... 416/219 R, 416/220 R, 248, 204 A, 213 R; 29/889.21
See application file for complete search history.

(56) References Cited

U.S. PATENT DOCUMENTS

| | | | | | |
|---|---|---|---|---|---|
| 2,605,996 | A | * | 8/1952 | Sturgess | 416/219 R |
| 2,751,189 | A | * | 6/1956 | Ledwith | 416/220 R |
| 3,014,695 | A | * | 12/1961 | Rankin et al. | 416/220 R |
| 4,767,274 | A | * | 8/1988 | Walter | 416/219 R |
| 4,812,107 | A | * | 3/1989 | Barcella et al. | 416/213 R |
| 5,238,368 | A | * | 8/1993 | Ortolano | 416/191 |
| 7,104,762 | B2 | * | 9/2006 | Dausacker et al. | 416/248 |
| 2005/0036886 | A1 | | 2/2005 | Tomberg | |
| 2005/0238492 | A1 | | 10/2005 | Dausacker et al. | |

FOREIGN PATENT DOCUMENTS

| | | | |
|---|---|---|---|
| CN | 1580498 | | 2/2005 |
| CN | 1644880 | | 7/2005 |
| JP | 53-126409 | | 11/1978 |
| JP | 57210104 | A * | 12/1982 |
| JP | 59226202 | A * | 12/1984 |
| JP | 62032201 | A * | 2/1987 |
| JP | 1-300001 | | 12/1989 |
| JP | 10-184305 | | 7/1998 |

OTHER PUBLICATIONS

Chinese Office Action in Chinese Application No. 200710004295 dated Feb. 12, 2009.

* cited by examiner

*Primary Examiner*—Richard Edgar
(74) *Attorney, Agent, or Firm*—Brundidge & Stanger, P.C.

(57) ABSTRACT

A steam turbine blade includes a blade; a shroud attached to a tip of the blade; a blade root projecting toward the radial inner circumferential side of a turbine rotor so as to be fitted into a blade groove provided in an outer circumferential portion of a turbine rotor; and a platform disposed between the blade and the blade root. The blade root is inserted into the blade groove along the axial direction of the turbine rotor. The blade, the shroud, the blade root and the platform are integrally molded. The number of the blade roots is larger than that of the blades.

10 Claims, 5 Drawing Sheets

SINGLE BLADE AND SINGLE BLADE ROOT

PRIOR ART

SINGLE BLADE AND DUAL BLADE ROOT

STEAM TURBINE BLADE, AND STEAM TURBINE AND STEAM TURBINE POWER PLANT USING THE BLADE

BACKGROUND OF THE INVENTION

1. Field of the Invention

The present invention relates to a novel steam turbine blade which is an axial entry, shroud-integrated type grouped blade, and a steam turbine using the steam turbine blade and a power plant with the steam turbine.

2. Description of the Related Art

A steam turbine blade has blade roots formed in various shapes. A turbine rotor is formed with blade grooves formed complementarily to the blade roots. The steam turbine blade is attached to the turbine rotor by fitting the blade roots to the blade grooves. One of the known structures of the blade root included in the steam turbine blade is a fir-tree axial entry blade root. In general, the fir-tree blade root is shaped symmetrically with respect to its centerline. A plurality of pairs of hooks are disposed on both sides of the centerline. During rotation of the turbine rotor, the plurality of pairs of hooks support a centrifugal force acting on the steam turbine blade.

It is a general method to join together a plurality of steam turbine blades through at least one of the platform and the shroud so as to form a grouped blade. Such a grouped blade has higher rigidity than that of a single steam turbine blade; therefore, they have an effect of suppressing vibration of the steam turbine blade during the operation of a turbine.

FIG. 9 is a perspective view illustrating the grouped blade structure of the conventional steam turbine blade. One of methods of forming a grouped blade is as below. A shroud attached to the tip of a blade is made of a member different from the blade. Portions called tenon disposed at the blade tips of a plurality of steam turbine blades are riveted. Thus, the blades of the plurality of steam turbine blades are joined to the single shroud to form a grouped blade. However, such a method has a probability that variations of tenon riveting work may vary strengths of riveted portions.

There are grouped blade structures that allow for the improvement of such a problem of the conventional method. In one of the grouped blade structures, a plurality of steam turbine blades have a common shroud and a common platform, and blades, the shroud, blade roots and the platform are integrally molded. For instance, JP-A 53-126409 describes a grouped blade structure in which a blade root is of fir-tree axial entry and three blades and two blade roots are integrally molded.

JP-A 1-300001 describes a grouped blade structure in which a blade root is of axial entry and has a T-head provided with only one pair of hooks relative to its centerline, and three blades and three blade roots are integrally molded.

JP-A 10-184305 describes a grouped blade structure in which two adjacent blades are integrally molded by one shroud, one platform and one blade root.

SUMMARY OF THE INVENTION

Methods of making a steam turbine more efficient include largely increasing the capacity of the steam turbine. Increasing the capacity of the steam turbine needs to increase a turbine rotor radial length of a blade of a steam turbine blade. The stress caused by a centrifugal force and a steam force acting on the steam turbine is increased with an increase in the length of the blade. Accordingly, it is necessary to provide a steam turbine blade structure that reduces the stress caused by a centrifugal force and a steam force for the steam turbine with a large capacity.

The control stage of a steam turbine is exposed to extremely high temperatures. In addition, steam jetted from nozzles is not uniform along the whole circumference. Therefore, the steam turbine blade experiences turbine rotor circumferential and axial shocks one or more times per rotation. It is necessary to provide a steam turbine blade structure having high strength-reliability that increases rigidity in the circumferential and axial directions of the turbine rotor and reduces the stress caused by a steam force, for the steam turbine blade used under such conditions.

FIG. 6 is a front view of an axial entry steam turbine blade that has a single blade root with a T-head for a single blade, in which the minimum width of a throat on a blade root hook is hb as viewed from the turbine rotor axial direction. FIG. 7 is a front view of an axial entry steam turbine blade that has dual blade roots with combined-shaped T-heads for a single blade, in which the minimum width of a throat on a blade root hook is ½×(hb) as viewed from the axial direction. FIG. 8 illustrates the relationship between bending stress occurring at the throat on the blade root hook and the minimum width hb of the throat when a circumferential load of 10 kN is applied to the turbine rotor radial outermost portion of the shroud in the respective configurations of FIGS. 6 and 7. However, in FIG. 8 bending stress is calculated on the assumption that turbine rotor axial thicknesses of the blade roots are each 100 mm in each of FIGS. 6 and 7, a distance L between the turbine rotor radial outermost circumferential portion of the shroud and the throat is 200 mm in each of FIGS. 6 and 7, and the volumes of the entire steam turbine blades are the same in FIGS. 6 and 7. In addition, in the structure depicted in FIG. 7, bending stress is calculated on the assumption that a distance d between an end of one blade root throat and an end of the other blade root throat.

In the two structures of FIGS. 6 and 7, the entire steam turbine blades have the same volume and the throats have the same sectional area of 100×hb (mm2). Therefore, both the structures have the same turbine rotor radial tensile stress generated at the throat by the centrifugal force acting on the steam turbine blade. However, as shown in FIG. 8, the structure having the single blade root for the single blade shown in FIG. 6 has greater bending stress generated at the throat by the circumferential load than the structure having the dual blade roots for the single blade shown in FIG. 7.

Incidentally, the conventional shroud integrated-type grouped blade has the structure having the single blade root for the single blade or the structure having the single blade root for the plurality of blades like the structures described in JP-A 53-126409, 1-300001 and 10-184305. Thus, FIGS. 6 to 8 show that it is effective to adopt a plurality of blade roots for a single blade in order to reduce the stress generated by a steam force in the conventional shroud-integrated type grouped blade.

The steam turbine blade having an axial entry blade root with one pair of or a plurality of pairs of hooks is configured not to fix the blade root in the turbine rotor circumferential and axial directions, like the structures described in JP-A 53-126409, 1-300001 and 10-184305. This poses a problem in that it is difficult to increase rigidity in the circumferential and axial directions of the turbine rotor.

It is an object of the present invention to provide a steam turbine blade having a high degree of strength reliability that reduces the stress caused by a steam force acting on a steam turbine blade during the operation of a steam turbine and increases rigidity in the circumferential and axial directions of the turbine rotor to suppress vibration of the steam turbine blade resulting from the steam force, and a steam turbine using the steam turbine blade and a power plant with the steam turbine.

According to one aspect of the present invention, there is provided a steam turbine blade including: a blade; a shroud attached to a tip of the blade; a blade root projecting toward the radial inner circumferential side of a turbine rotor so as to be fitted into a blade groove provided in an outer circumferential portion of the turbine rotor; and a platform disposed between the blades and the blade roots; wherein the blade root is inserted into the blade groove along the axial direction of the turbine rotor; and wherein the blade, the shroud, the blade root and the platform are integrally molded, and the number of the blade roots is larger than that of the blades.

Since the number of the blade roots is made larger than that of the blades as described above, the stress caused by a steam force acting on the steam turbine blade during the operation of the steam turbine can be reduced as shown in FIGS. 6 to 8.

The steam turbine blade of the present invention is configured such that a plurality of the blades form part of a unitary grouped blade having the single shroud and the single platform, the blades, the shroud, the blade roots and the platform are integrally molded, the number of the blades is one through four, and the number of the blade roots is larger than that of the blades. Preferably, the number of the blade roots is two or three for the single blade, three to five for dual blades, four to seven for the three blades, or five to nine for four blades.

Preferably, two, three or four blades can be formed into one unit by joining together adjacent surfaces of at least one of the shrouds adjacent to each other and the platforms adjacent to each other by any one of welding, brazing, and friction stir welding. It is possible to integrate the entire one stage of a turbine and build it into the turbine.

As described above, since the steam turbine blade is formed as a shroud integrated type grouped blade, it exhibits higher rigidity than a single steam turbine blade. Thus, the vibration of the steam turbine blade occurring during the operation of the turbine can be suppressed.

Further, since the number of the blade roots of the unitary grouped blade is made larger than that of the blades, the stress caused by a steam force acting on the steam turbine blade can be reduced during the operation of the turbine as shown in FIGS. 6 to 8.

Preferably, each of the blade root and the blade groove is symmetrical with respect to the centerline of each of the blade root and the blade groove as viewed from the turbine rotor axial direction. The blade root and the blade groove are respectively provided with blade root hooks and blade groove hooks on both sides of the centerline so that the blade root hook and the blade groove hook form a pair on each side of the centerline. During the operation of the steam turbine, the blade root hook and the blade groove hook are abutted against each other to support a centrifugal force acting on the steam turbine blade. In addition, preferably, a portion where the blade root hook is in contact with the blade groove is provided with a hole adapted to receive a fixing pin joined thereto so as to extend to the blade root hook and the blade groove hook, the fixing pin being inserted into the hole toward the axial direction of the turbine rotor. Thus, the insertion of the fixing pin into the hole fixes the turbine rotor and the blade root with each other in the circumferential and radial directions.

As described above, the fixing pin is inserted into the portion where the blade root hook is in contact with the blade groove hook so as to fix the turbine rotor and the blade root with each other in the circumferential and radial directions of the turbine rotor. This increases the rigidity of the steam turbine blade in the circumferential and radial directions of the turbine rotor. Consequently, the vibration of the steam turbine blade caused by the steam force during the operation of the turbine can be suppressed.

Preferably, the steam turbine blade configured as described above according to the present invention is manufactured by precision casting and then surface luster finish or by forging, then machining or electric discharge machining for shaping, and then surface luster finish.

Preferably, the steam turbine blade of the present invention is configured such that the material strength $\sigma rb$ of the blade root, the material strength $\sigma rw$ of the blade groove, the minimum width hb of a throat on the blade root hook as viewed from the axial direction of the turbine rotor, and the minimum width hw of a throat under the blade groove hook of the turbine rotor as viewed from the axial direction of the turbine rotor fall in a range specified by the following formula: $\sigma rb \times hb \leqq \sigma rw \times hw$. Incidentally, each of the material strength $\sigma rb$ of the blade root and the material strength $\sigma rw$ of the blade groove is preferably any one of creep rupture strength, tensile strength and yield stress.

With such a configuration, tolerance to damage at the throat of the blade root of the steam turbine blade can be made equal to that at the throat of the blade groove. Conceivably, tolerance to damage at the throat of the blade groove can be made greater than that at the throat of the blade root of the steam turbine blade.

According to another aspect of the present invention, there is provided a steam turbine including turbine moving blades; and a turbine rotor having a plurality of stages into which the turbine moving blades are inserted; wherein the moving blade used in at least one of the stages is the steam turbine blade described above. Preferably, at least one of the stages is a control stage. Preferably, the turbine rotor includes a shaft and a disk contiguous thereto and the disk is formed along the axial direction thereof with a plurality of disk portions into which the moving blades are inserted.

The steam turbine of the present invention can be applied to any one of a high pressure turbine, a high-intermediate pressure integrated type turbine and a high-low pressure integrated type turbine. This makes it possible to achieve a steam turbine power plant with a high degree of thermal efficiency.

As described above, the steam turbine blade of the present invention is preferably installed in at least one stage, preferably, a control stage, of a high temperature and high pressure steam turbine having a plurality of stages. The control stage of the steam turbine is exposed to extremely high temperatures. In addition, steam jetted from nozzles is not uniform along the whole circumference. Therefore, the steam turbine blade experiences turbine rotor circumferential and axial shocks one or more times per rotation. The steam turbine blade of the present invention that has high rigidity and reduces generated stress is provided for the stage used under such conditions. This increases the strength-reliability of the entire steam turbine.

The present invention can provide the steam turbine blade having a high degree of strength reliability that reduces the stress caused by a steam force acting on a steam turbine blade during the operation of a steam turbine and increases rigidity to suppress vibration of the steam turbine blade resulting from the steam force, and a steam turbine using the steam turbine blade and a power plant with the steam turbine.

DESCRIPTION OF THE PREFERRED EMBODIMENTS

Specific embodiments of the present invention will be described below. However, the invention should not be limited by the embodiments.

First Embodiment

Figure 1:
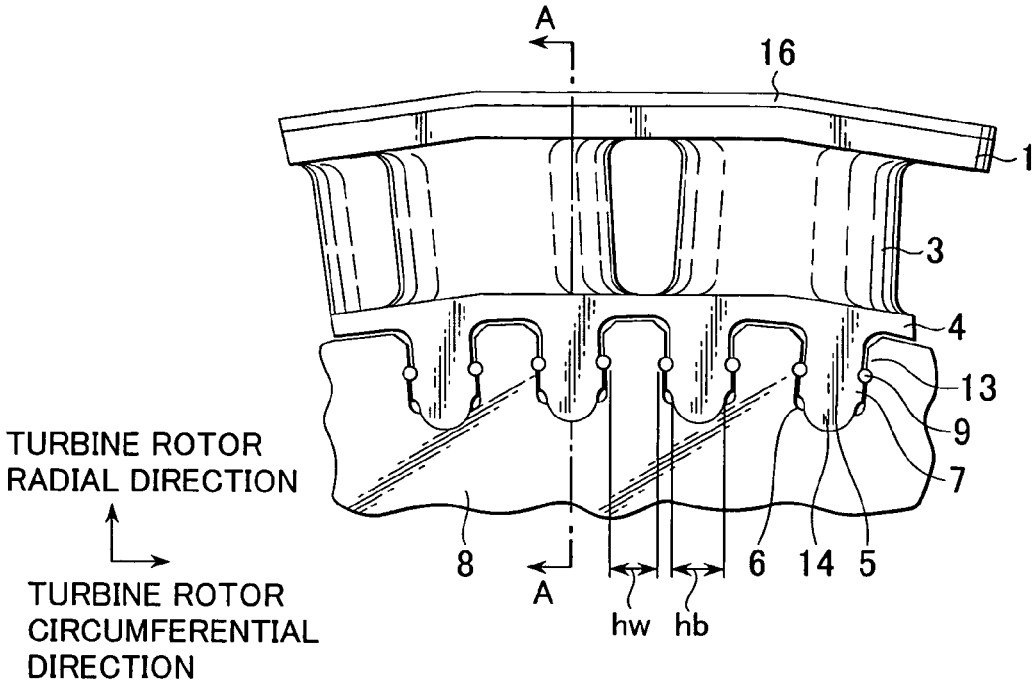
FIG. 1 is a front view of a steam turbine blade according to a first embodiment of the present invention as viewed from the turbine rotor axial direction and the steam inflow side.
Figure 2:
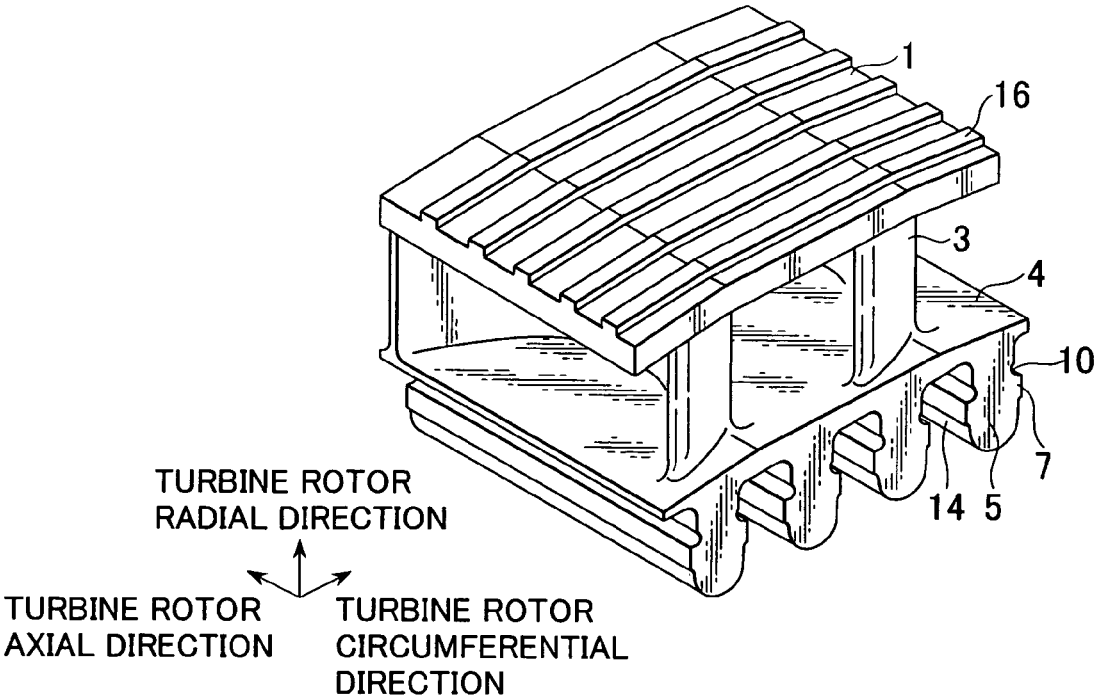
FIG. 2 is a perspective view of the steam turbine blade of FIG. 1.
Figure 3:
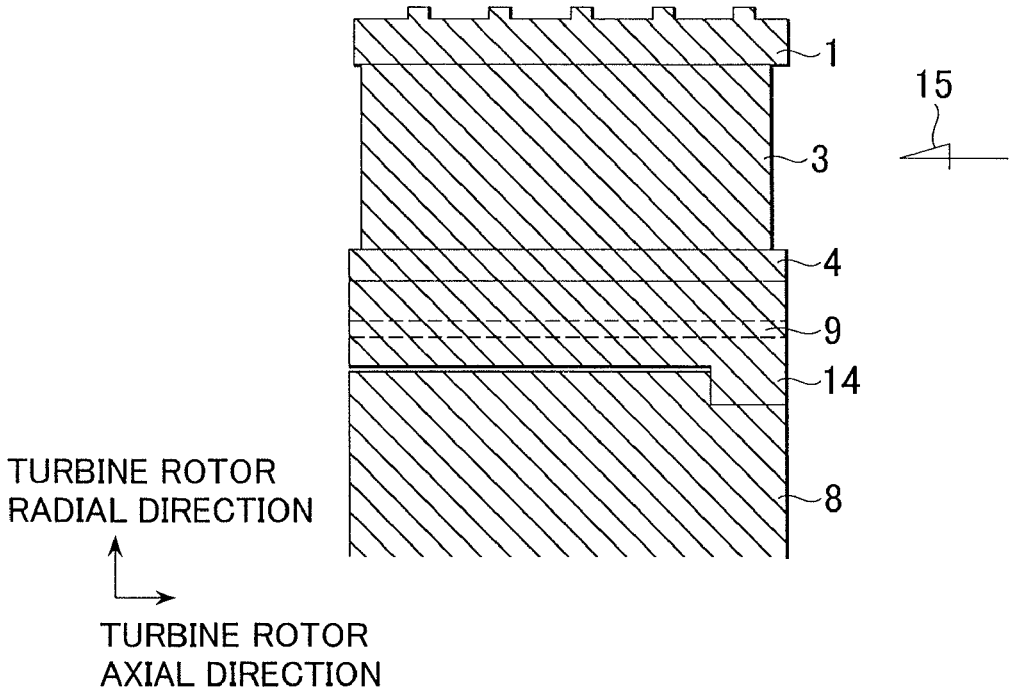
FIG. 3 is a cross-sectional view of the steam turbine blade taken along line A-A of FIG. 1.

FIG. 1 is a front view of a steam turbine blade according to a first embodiment of the present invention as viewed from the turbine rotor axial direction and the steam inflow side. FIG. 2 is a perspective view of the steam turbine blade. FIG. 3 is a cross-sectional view of the steam turbine blade taken along line A-A of FIG. 1. The steam turbine blade of the present invention includes blades 3, a shroud 1 attached to the tips of the blades 3, blade roots 5, and a platform 4 disposed between the blades 3 and the blade roots 5. The blade root 5 is provided in the steam turbine blade so as to project toward the radially inner circumferential side of a turbine rotor 8 and is fitted to a blade groove 6 provided on the outer circumferential portion of the turbine rotor 8. The steam turbine blade is an axial entry steam turbine blade in which the blade root 5 is inserted into the blade groove 6 in the axial direction of the turbine rotor.

A projecting thrust stopper 14 adapted to support the thrust force resulting from a steam flow 15 is provided at one end of the blade root 5 on the steam inflow side so as to have a desired length at the terminating portion of the blade root 5 in the axially inserting direction. The blade groove 6 of the turbine rotor 8 has a shape similar to the insertable shape of the blade root 5 and is formed with a step to support the thrust stopper 14.

A plurality of seal fins 16 formed as projections are provided on the entire outer circumference of the shroud 1 of the steam turbine blade so as to extend in the rotational direction thereof. The seal fins 16 in the embodiment are five rectangular projections.

A plurality of the steam turbine blades of the present invention form a unitary-grouped blade having a common shroud 1 and a common platform 4. The blades 3, the blade roots 5 and the platform 4 included in the unitary-grouped blade are integrally molded. In the unitary-grouped blade, the number of the blades is two and the number of blade roots is four. The steam turbine blade of the present embodiment is such that the number of the blades 3 is preferably 1 through 4 and can provide the following combinations: two or three blade roots 5 for one blade 3; three to five blade roots 5 for two blades 3; four to seven blade roots 5 for three blades 3; five to nine blade roots 5 for four blades 3. Thus, the present invention should not be limited by the structure depicted in FIGS. 1 and 2.

As described above, the steam turbine blade is formed as the shroud-integrated type grouped blade; therefore, it can exhibit higher rigidity than a single steam turbine blade and suppress the vibration of the steam turbine occurring during the operation of the steam turbine. Further, the number of the blade roots 5 is larger than that of the blades 3. Therefore, the stress caused by the steam force acting on the steam turbine blade can be reduced during the operation of the steam turbine.

In the present embodiment, each of the blade root 5 and the blade groove 6 is symmetrical with respect to the respective centerlines of the blade root 5 and the blade groove 6 as viewed from the axial direction of the turbine rotor. The blade root 5 and the blade groove 6 have a pair of the blade root hook 7 provided on the blade root 5 and a blade groove hook 13 provided on the blade groove 6 on each side of the centerlines. The blade root hook 7 and the blade groove hook 13 have their heads formed wider than their roots in the circumferential direction of the turbine rotor. The engagement of the heads with the corresponding roots can bear a load resulting from the centrifugal force acting on the turbine blade. The side face of the blade root 5 is formed of a curve in cross section at the end of the turbine rotor 8 on the radial center side thereof; however, it can be formed of a plurality of straight lines one of which forms the bottom of the side face.

Further, a hole is provided at a portion where the blade root hook 7 is in contact with the blade groove hook 13. This hole is adapted to receive a fixing pin 9 joined thereto so as to extend to both the blade root 7 and the blade groove hook 13. In addition, the fixing pin 9 is inserted into the hole toward the axial direction of the turbine rotor 8. Preferably, after inserted into the blade grooves 6, the steam turbine blade is fixed in the circumferential and radial directions of the turbine rotor 8 by insertion of the fixing pins 9.

As described above, the steam turbine blade is fixed in the circumferential and radial directions of the turbine rotor by inserting the fixing pin 9 into the portion where the hooks of the blade root 5 and the blade groove 6 come into contact with each other. This increases the rigidity of the steam turbine blade in the circumferential and axial directions of the turbine rotor 8. The increased rigidity can suppress the vibration of the steam turbine blade resulting from the steam force during the operation of the steam turbine.

The steam turbine blade of the present embodiment is preferably configured so that the material strength σrb of the blade root 5, the material strength σrw of the blade groove 6, the minimum width hb of the throat on the blade root hook 7 as viewed from the axial direction of the turbine rotor 8, and the minimum width hw of the throat under the blade groove hook 13 as viewed from the axial direction of the turbine rotor 8 may fall in the range specified by the following formula: $\sigma rb \times hb \leqq \sigma rw \times hw$. Incidentally, each of the material strength σrb of the blade root 5 and the material strength σrw of the blade groove 6 is preferably any one of creep rupture strength, tensile strength and yield stress. With such a configuration, tolerance to damage at the throat of the blade root 5 of the steam turbine blade is equal to that at the throat of the blade groove 6. Conceivably, tolerance to damage at the throat of the blade groove 6 of the steam turbine blade can be made greater than that at the throat of the blade root 5.

The steam turbine blade according to the present embodiment is preferably manufactured by precision casting and then surface luster finish. Alternatively, the steam turbine blade is preferably manufactured by forging, then machining or electro-discharge machining for shaping and then by surface luster finish.

The turbine rotor 8 includes a shaft and a disk contiguous to the shaft. A plurality of disk portions into which the steam turbine blades are inserted are formed on the disk along the axial direction thereof.

The steam turbine blade of the present embodiment is preferably installed in at least one stage, preferably a control stage, among a plurality of stages included in the steam turbine. The control stage of the steam turbine is exposed to an extremely high temperature of 500° C. or more. In addition, steam jetted from nozzles is not uniform along the whole circumference. Therefore, the steam turbine blade experiences turbine rotor circumferential and axial shocks one or more times per rotation. The steam turbine blade of the present invention that has high rigidity and reduces generated stress is provided for the stage used under such conditions. This increases the strength-reliability of the entire steam turbine.

As described above, the present embodiment can provide a steam turbine blade having a high degree of strength-reliability that reduces the stress caused by a steam force acting on a steam turbine blade during the operation of a steam turbine and increases rigidity to suppress vibration of the steam turbine blade resulting from the steam force.

Second Embodiment

Figure 4:
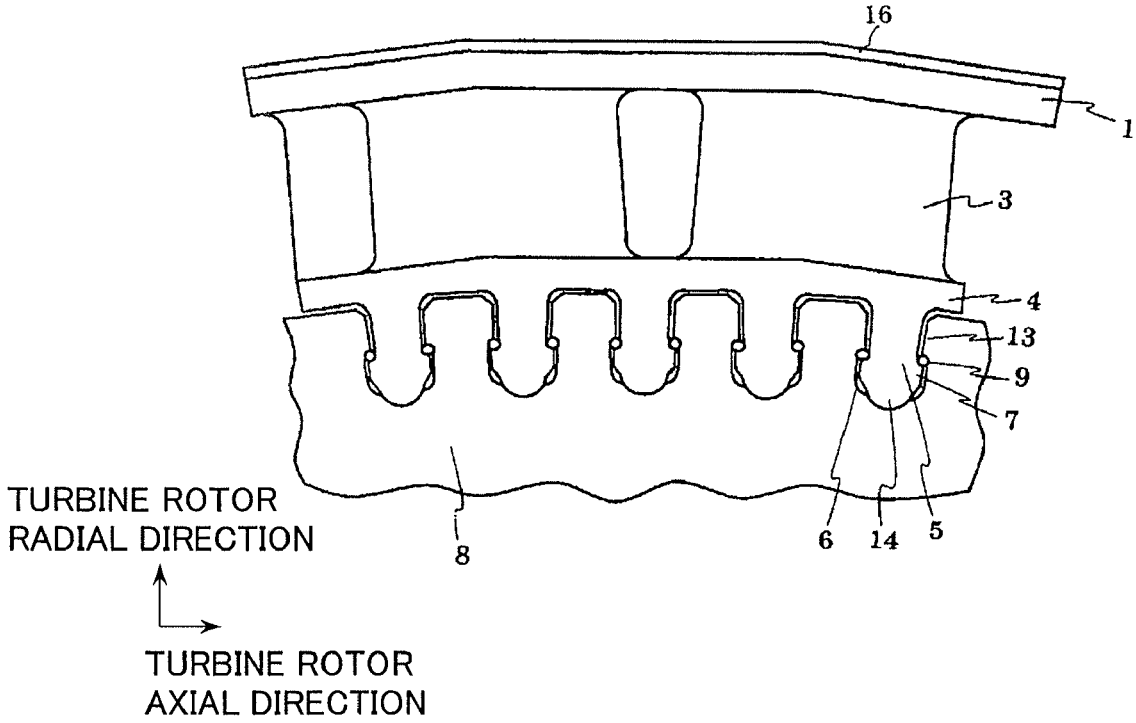
FIG. 4 is a front view of a steam turbine blade according to a second embodiment of the present invention as viewed from the turbine rotor axial direction and the steam inflow side.

FIG. 4 is a front view of a steam turbine blade according to a second embodiment of the present invention as viewed from the turbine rotor axial direction and the steam inflow side. As shown in FIG. 4, this steam turbine blade has five blade roots 5 for two blades 3 associated therewith. The steam turbine blade of the present embodiment has a shroud 1, the blade roots 5 and blade grooves 6 which are configured similarly to those of the first embodiment. The shroud 1 is provided with seal fins 16, which are preferably formed in the same manufacturing method as that of the first embodiment. Three blade roots may be provided for two blades associated therewith.

In the present embodiment, the steam turbine blade is formed as a shroud-integrated type grouped blade; therefore, it can exhibit higher rigidity than a single steam turbine blade and suppress the vibration of the steam turbine occurring during the operation of the steam turbine. Since the five blade roots 5 are provided for the two blades 3 associated therewith, the stress caused by the steam force acting on the steam turbine blade during the operation of the steam turbine can be more reduced than that of the steam turbine blade of the first embodiment.

As with the first embodiment, the steam turbine blade of the present embodiment is preferably configured so that the material strength σrb of the blade root 5, the material strength σw of the blade groove 6, the minimum width hb of the throat on the blade root hook 7 as viewed from the axial direction of the turbine rotor 8, and the minimum width hw of the throat under the blade groove hook 13 as viewed from the axial direction of the turbine rotor 8 may fall in the range specified by the following formula: $\sigma rb \times hb \leqq \sigma rw \times hw$.

Also the present embodiment can provide a steam turbine blade having a higher degree of strength-reliability that reduces the stress caused by a steam force acting on a steam turbine blade during the operation of a steam turbine and increases rigidity to suppress vibration of the steam turbine blade resulting from the steam force, as compared with the steam turbine blade of the first embodiment.

Third Embodiment

Figure 5:
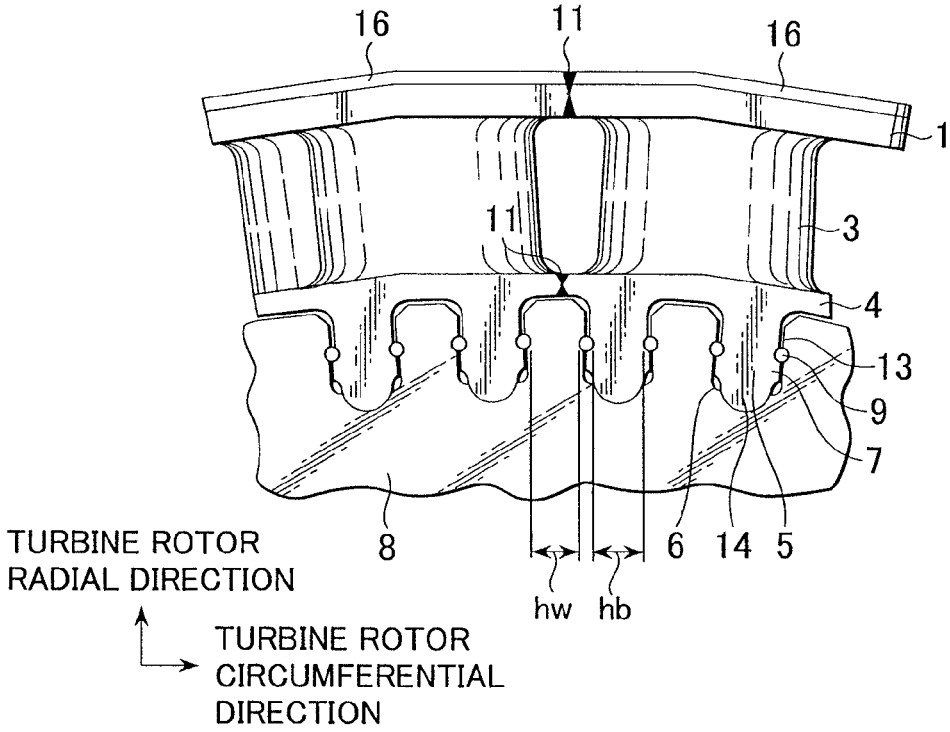
FIG. 5 is a front view of a steam turbine blade according to a third embodiment of the present invention as viewed from the turbine rotor axial direction and the steam inflow side.
Figure 6:
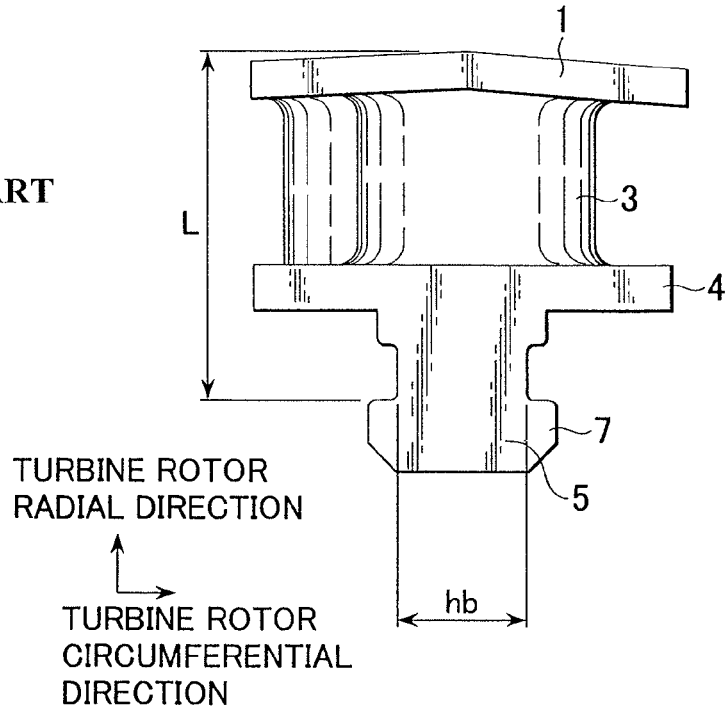
FIG. 6 is a front view of an axial entry steam turbine blade having a single blade root with a T-head for a single blade, in which a throat on blade root hooks has the minimum width of hb as viewed from the turbine rotor axial direction.
Figure 7:
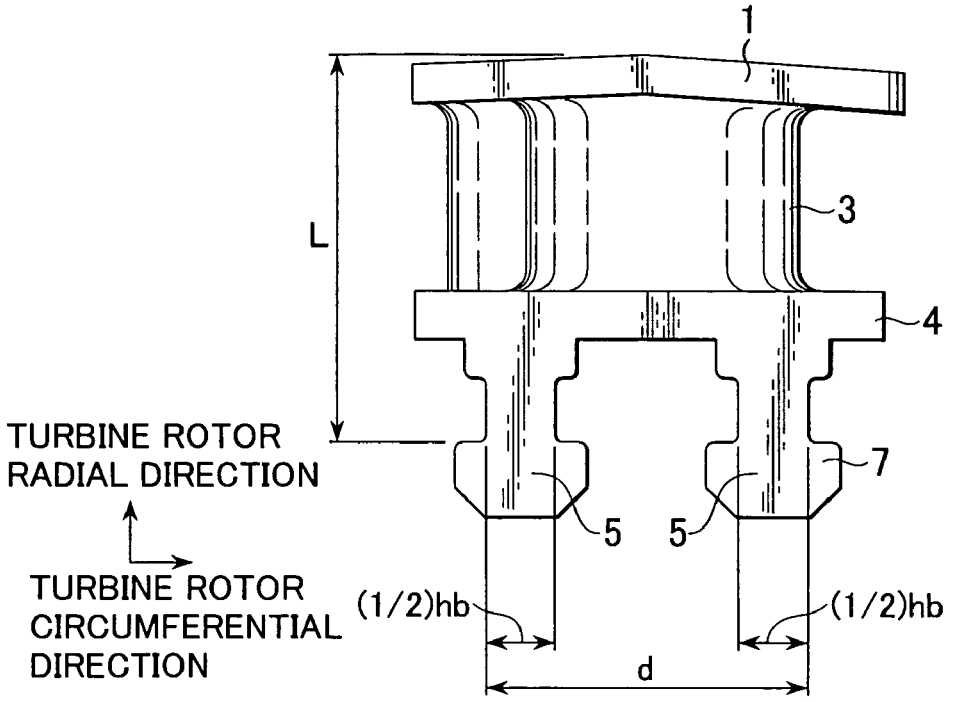
FIG. 7 is a front view of an axial entry steam turbine blade having dual T-head blade roots with the same shape for a single blade, in which a throat on blade root hooks has the minimum width of (½)hb as viewed from the turbine rotor axial direction.
Figure 8:
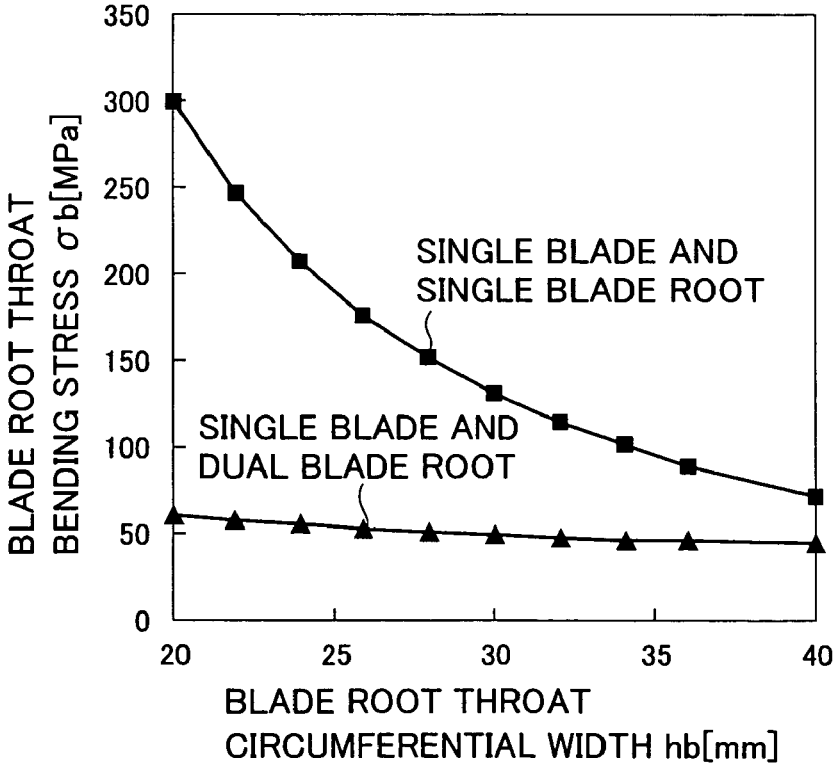
FIG. 8 is a diagram showing the relationship between the minimum width hb of the throat on the blade root hooks and bending stress occurring at the throat when a circumferential load of 10 kN is applied to the turbine rotor radial outermost portion of the shroud in the respective configurations of FIGS. 6 and 7.
Figure 9:
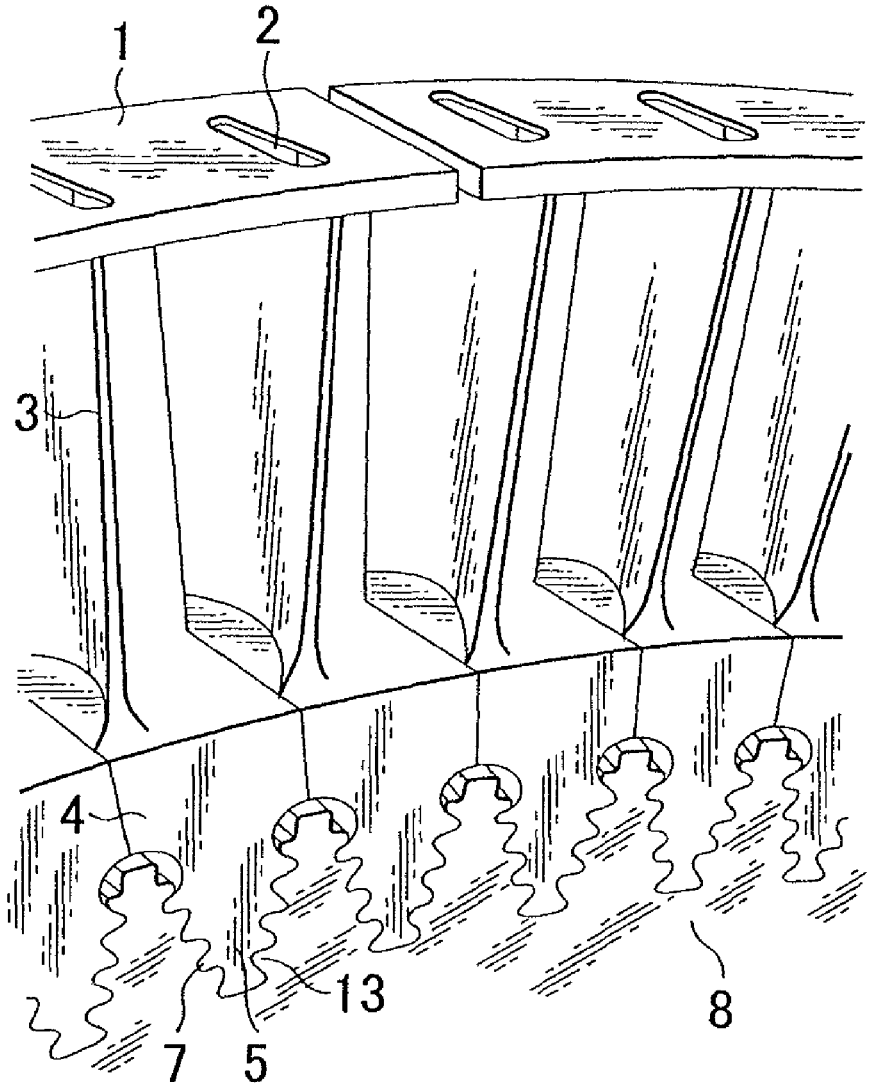
FIG. 9 is a perspective view of a steam turbine blade having the convention grouped blade structure.
Figure 9:
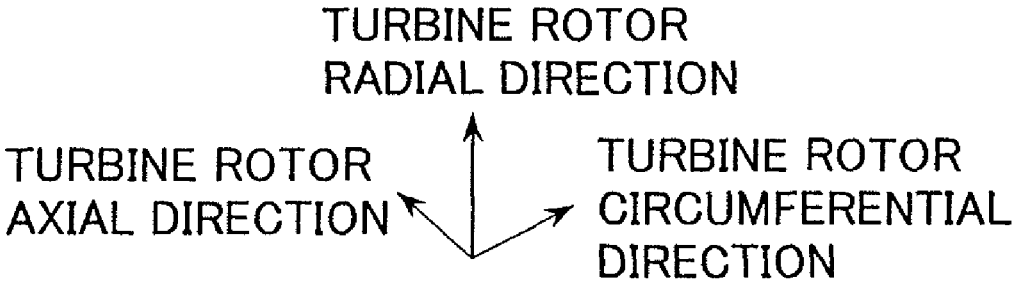

FIG. 5 is a front view of a steam turbine blade according to a third embodiment of the present invention as viewed from the turbine rotor axial direction and the steam inflow side. The steam turbine blade of the present embodiment is formed by joining together two steam turbine blades each having two blade roots 5 and one blade 3 associated therewith, thereby providing a shroud-integrated type grouped blade which has four blade roots 5 and two blades 3 associated therewith. This joint is performed by joining together the adjacent surfaces of at least one of shrouds 1 adjacent to each other and platforms 4 adjacent to each other by any one of welding, brazing, and friction stir welding. For the welding, it is preferred to provide an X-groove and use a similar composition welding metal. Incidentally, it is possible to provide a steam turbine blade formed as a shroud-integrated type grouped blade, by welding, which has three blades 3 and six blade roots 5.

The steam turbine blade of the present embodiment has the shrouds 1, the blade roots 5 and blade grooves 6 which are configured similarly to those of the first embodiment. The shroud 1 is provided with the seal fins 16, which are preferably formed in the same manufacturing method as that of the first embodiment.

While the position joined by welding, brazing or friction stir welding according to the present embodiment is not limited by FIG. 5, it is preferred that the position be lower than other positions in tensile stress or bending stress applied vertically to the joint surface. As described above, welding, brazing or friction stir welding is adopted as means for forming the grouped blade. Therefore, machining cost and manufacturing cost for the shroud-integrated type grouped blade in which the plurality of steam turbine blades have the common shroud 1 and the common platform 4 can be reduced compared with those for the grouped blade formed by precision casting, or forging and machining or electric discharge machining.

As with the first embodiment, preferably the steam turbine blade of the present embodiment is configured so that the material strength σrb of the blade root 5, the material strength σrw of the blade groove 6, the minimum width hb of the throat on the blade root hook 7 as viewed from the axial direction of the turbine rotor 8, and the minimum width hw of the throat under the blade groove hook 13 as viewed from the axial direction of the turbine rotor 8 may fall in the range specified by the following formula: $\sigma rb \times hb \leqq \sigma rw \times hw$.

The present embodiment can provide, at low cost, a steam turbine blade having a high degree of strength-reliability that reduces the stress caused by a steam force acting on a steam turbine blade during the operation of a steam turbine and increases rigidity to suppress vibration of the steam turbine blade resulting from the steam force.

Fourth Embodiment

In a fourth embodiment, the steam turbine blade described in the first, second or third embodiment is used in a control stage of each of a high pressure steam turbine, a high-intermediate pressure integrated type steam turbine, and a high-intermediate-low pressure integrated type steam turbine.

The high-pressure steam turbine (HP) is designed such that a first stage of the turbine blade serves as a control stage, which is of double flow, and nine stages are provided in one side. Respective stationary blades are arranged to correspond to the turbine blades. The turbine rotor includes a shaft and a disk contiguous to the shaft. A plurality of disk portions into which the turbine blades are inserted are formed on the disk along the axial direction thereof. The disk portions are formed with blade grooves arranged in the axial direction. The blade groove has a cross-sectional shape similar to that of the blade root. All turbine blades including those of the control stage which is the first stage are inserted into the blade grooves. In the present embodiment, an intermediate pressure steam turbine (IP) and a low pressure steam turbine (LP) are connected the high pressure steam turbine (HP). Specifically, the high pressure steam turbine (HP), the intermediate pressure steam turbine (IP) and a generator are combined with two low pressure steam turbines (LP) and a generator. Alternatively, the high pressure steam turbine (HP), the low pressure steam turbine (LP) and a generator are combined with the intermediate pressure steam turbine (IP), the low pressure steam turbine (LP) and a generator. The combinations as described above can constitute steam turbine power plants operating at a main steam temperature of 500° C. or more.

A high-intermediate pressure integrated steam turbine includes a turbine rotor into which a high pressure portion (HP) and an intermediate pressure portion (IP) are combined. High pressure steam is directed to the turbine blades of a control stage which is a first stage located on the high pressure side, from a nozzle box disposed at the central portion of the turbine rotor. Then the high pressure steam passes through eight-stage turbine blades in the high pressure portion and is directed to the six-stage turbine blade in the intermediate pressure portion. Respective stationary blades are arranged to correspond to the turbine blades. The turbine rotor includes a shaft and a disk contiguous to the shaft. A plurality of disk portions into which the turbine blades are inserted are formed on the disk along the axial direction thereof. The disk portions are formed with blade grooves arranged in the axial direction. The blade groove has a cross-sectional shape similar to that of the blade root. All turbine blades including those of the control stage which is the first stage are inserted in the blade roots. In the present embodiment, the high and intermediate pressure integrated type steam turbine (HP-IP) and one or two lower pressure steam turbines (LP) can constitute a steam turbine power plant. In this steam turbine power plant, the main steam of the high pressure steam turbine (HP) and the steam of the intermediate steam turbine (IP) are heated by a re-heater to a temperature of 500° C. or more and are introduced thereinto.

A high-intermediate-low pressure integrated type steam turbine includes a turbine rotor into which a high pressure portion (HP) and an intermediate-low pressure portion (IP-LP) are combined. This steam turbine can constitute a steam turbine power plat. In this steam turbine power plant, high pressure steam having a main steam temperature of 500° C. or more is directed from a nozzle box disposed at a position slightly shifted from the central portion of the turbine rotor, to the turbine blades of a control stage which is a first stage on the high pressure side. Then, the steam passes through six-stage turbine blades of the high pressure portion and is directed to eight-stage turbine blades of the intermediate-low pressure portion (IP-LP). Respective stationary blades are arranged to correspond to the turbine blades. The turbine rotor includes a shaft and a disk contiguous to the shaft. A plurality of disk portions into which the turbine blades are inserted are formed on the disk along the axial direction thereof. The disk portions are formed with blade grooves arranged in the axial direction. The blade groove has a cross-sectional shape similar to that of the blade root. All turbine blades including those of the control stage which is the first stage are inserted in the blade roots.

The present embodiment can also provide the steam turbine blade having a high degree of strength-reliability that reduces the stress caused by a steam force acting on a steam turbine blade during the operation of a steam turbine and increases rigidity to suppress vibration of the steam turbine blade resulting from the steam force, as with the case of using the steam turbine blade in each of the first, second and third embodiments. Thus, the present embodiment can provide the steam pressure turbine power plant with high thermal efficiency.

What is claimed is:

1. A steam turbine blade comprising:

a plurality of blades;

a shroud attached to tips of the blades;

a plurality of blade roots projecting toward the radial inner circumferential side of a turbine rotor so as to be each fitted into a plurality of blade grooves each provided in an outer circumferential portion of the turbine rotor; and a platform disposed between the blades the blade roots;

wherein the blade roots are each inserted into the blade grooves along the axial direction of the turbine rotor; and, wherein the blades form part of a unitary grouped blade having the single shroud and the single platform, the blades, the shroud, the blade roots and the platform are integrally molded, the number of the blades is two through four, and the number of the blade roots is larger than that of the blades.

2. The steam turbine blade of claim 1, wherein adjacent surfaces of at least one of shrouds adjacent to each other and platforms adjacent to each other are joined together by any one of welding, brazing, and friction stir welding.

3. The steam turbine blade of claim 1, wherein each of the blade roots and the blade grooves is symmetrical with respect to the centerline thereof, respectively, as viewed from the axial direction of the turbine rotor, each of the blade roots and blade grooves are respectively provided with blade root hooks and blade groove hooks on both sides of the centerline so that a blade root hook and a blade groove hook form a pair on each side of the centerline, and each blade root hook and blade groove hook pair are abutted against each other to support a centrifugal force acting on the steam turbine blade.

4. The steam turbine blade of claim 3, wherein a portion where the blade root hook is in contact with the blade groove hook is provided with a hole adapted to receive a fixing pin joined thereto so as to extend to the blade root hook and the blade groove hook, the fixing pin being inserted into the hole toward the axial direction of the turbine rotor, and the insertion of the fixing pin into the hole fixes the turbine rotor and the blade root with each other in the circumferential and radial directions.

5. The steam turbine blade of claim 1, wherein the blades, the shroud, the blade roots and the platform are integrally molded by precision casting or forging.

6. The steam turbine blade of claim 1, wherein a material strength $\sigma rb$ of a blade root, a material strength $\sigma rw$ of a blade groove, a minimum width hb of a throat on a blade root hook as viewed from the axial direction of the turbine rotor, and a minimum width hw of a throat under a blade groove hook of the turbine rotor as viewed from the axial direction of the turbine rotor are set to fall in a range specified by the following formula: $\sigma rb \times hb \leqq \sigma rw \times hw$.

7. A steam turbine comprising:

turbine blades; and a turbine rotor having a plurality of stages into which the turbine blades are inserted;

wherein the turbine blade used in at least one of the stages is the steam turbine blade according to claim 1.

8. The steam turbine of claim 7, wherein the at least one of the stages is a control stage.

9. The steam turbine of claim 7, wherein the turbine rotor includes a shaft and a disk contiguous to the shaft, and the disk is formed along the axial direction of the shaft with a plurality of disk portions into which the turbine blades are inserted.

10. A steam turbine power plant in which any one of a high pressure turbine, a high-intermediate pressure integrated type turbine and a high-low pressure integrated type turbine is the steam turbine according to claim 7.

* * * * *